US007721387B1

(12) United States Patent
Mullet et al.

(10) Patent No.: US 7,721,387 B1
(45) Date of Patent: May 25, 2010

(54) TRACK ASSEMBLY FOR AN OVERHEAD DOOR

(75) Inventors: Willis J. Mullet, Gulf Breeze, FL (US); Derek S. Paquette, Daphne, AL (US); Gregory M. Rusnak, Milton, FL (US)

(73) Assignee: Overhead Door Corporation, Lewisville, TX (US)

( * ) Notice: Subject to any disclaimer, the term of this patent is extended or adjusted under 35 U.S.C. 154(b) by 196 days.

(21) Appl. No.: 11/147,006

(22) Filed: Jun. 6, 2005

Related U.S. Application Data

(63) Continuation-in-part of application No. 10/421,189, filed on Apr. 22, 2003, now abandoned.

(51) Int. Cl.
*B61D 19/00* (2006.01)

(52) U.S. Cl. ..... 16/96 R; 16/94 R; 16/DIG. 1; 49/199; 160/201

(58) Field of Classification Search ..... 16/87 R, 16/90, 87.4 R, 91, 94 R, 96 R, DIG. 1, 96, 16/87, 4 R, DIG. 10; 49/199, 200; 160/201, 160/209, 188, 189, 178.1 R
See application file for complete search history.

(56) References Cited

U.S. PATENT DOCUMENTS

| | | | | | |
|---|---|---|---|---|---|
| 2,083,467 | A | | 6/1937 | Morris | 20/20 |
| 2,327,778 | A | * | 8/1943 | Ferris et. al. | 160/209 |
| 2,630,597 | A | | 3/1953 | Robinson | 16/198 |
| 3,848,920 | A | | 11/1974 | Linhart et al. | 296/106 |
| 4,068,345 | A | * | 1/1978 | Hehl et al. | 16/94 D |
| 5,036,899 | A | | 8/1991 | Mullet | 160/189 |
| 5,240,216 | A | | 8/1993 | Lin et al. | 248/300 |
| 5,409,051 | A | | 4/1995 | Mullet et al. | 160/201 |
| 5,429,170 | A | * | 7/1995 | Nogaki | 160/201 |
| 5,568,672 | A | | 10/1996 | Mullet et al. | 16/94 R |
| 5,718,533 | A | | 2/1998 | Mullet et al. | 403/393 |
| 5,954,111 | A | | 9/1999 | Ochoa | 160/201 |
| 5,992,497 | A | | 11/1999 | Jaehnen et al. | 160/201 |
| 6,047,761 | A | | 4/2000 | Jaehnen et al. | 160/201 |
| 6,089,304 | A | | 7/2000 | Mullet et al. | 160/209 |
| 6,227,281 | B1 | | 5/2001 | Martin | 160/201 |
| 6,250,360 | B1 | | 6/2001 | Ochoa | 160/201 |

(Continued)

FOREIGN PATENT DOCUMENTS

| | | |
|---|---|---|
| EP | 1 170 450 A | 1/2002 |

*Primary Examiner*—William L. Miller
(74) *Attorney, Agent, or Firm*—Renner, Kenner, Greive, Bobak, Taylor & Weber

(57) ABSTRACT

A track assembly for an overhead door (10) includes a generally vertically positionable track segment (14) and a generally horizontally positionable track segment (15). The track segment (14) includes a curvilinear portion (17) at one end thereof which telescopically receives a curvilinear portion (21) of the track segment (15). The curvilinear portion (17) of the track segment (14) has a smaller radius of curvature than the curvilinear portion (21) of the track segment (15). In one embodiment, a bracket (30) has tabs (40) which are received in a slot aperture (42) in the curvilinear portion (17) to attach it to the bracket (30), and the bracket (30) has a lug (41) which is received in a slot (44) in the curvilinear portion (21) to attach it to the bracket (30). In another embodiment, the track segment (14) is carried by a bracket (51), and the track segment (15) is carried by a bracket (52) with the telescopic relationship being the only connection between the track segments (14, 15).

9 Claims, 5 Drawing Sheets

U.S. PATENT DOCUMENTS 6,527,035 B2 3/2003 Hoofard et al. ..... 160/201
6,554,047 B1 4/2003 Mondragon et al. ..... 160/201
6,719,032 B1 * 4/2004 Miers ..... 160/188
6,745,814 B2 * 6/2004 Hoofard et al. ..... 160/201
7,059,379 B2 * 6/2006 Lewis et al. ..... 160/191
2004/0211033 A1 * 10/2004 Mullet et al. ..... 16/96 R

* cited by examiner

TRACK ASSEMBLY FOR AN OVERHEAD DOOR

CROSS-REFERENCE TO RELATED APPLICATION

This application is a continuation-in-part of U.S. patent application Ser. No. 10/421,189 filed Apr. 22, 2003 now abandoned.

TECHNICAL FIELD

The present invention relates to a track assembly for sectional overhead doors such as garage doors and the like. More specifically, this invention relates to such an assembly which is particularly suited for low headroom environments.

BACKGROUND ART

Overhead sectional garage doors or the like are typically provided with rollers that ride in a track system usually carried by a horizontally oriented angle member extending inwardly from the door frame. When the door is in the closed position, the rollers reside in opposed vertically oriented tracks, and when moved to an open position, the rollers travel up the vertical tracks, through opposed transitional tracks, and into opposed generally horizontally oriented tracks.

Traditionally, the transitional tracks are of a circular radius of curvature to make the ninety degree transition from the vertical tracks to the horizontal tracks. These transitional tracks may be a separate piece, having their ends attached to the vertical and horizontal tracks, or they may be incorporated into either the vertical tracks or the horizontal tracks thereby creating a two-piece system instead of a three piece system. In some instances, the track system may be formed as one piece incorporating the vertical tracks, the horizontal tracks and the transitional tracks.

The radius of the typical prior art transitional tracks generally varies between eight inches and thirty inches. Radii toward the upper end of the range are desirable because such provides for a smoother operation of the door. However, such requires more headroom. In situations where there is minimal headroom, transitional tracks with a short radius must be utilized to the sacrifice of smooth operation.

As a compromise, attempts have been made at providing a one piece track system which includes the vertical tracks, the horizontal tracks, and a transitional track portion having two radii of curvature. However, in order to accommodate for low headroom environments and yet still satisfactorily operate, the radii of curvature need to be quite different, that is, one of the radii needs to be substantially smaller than the other radii, and such cannot be readily accomplished in one piece.

Thus, the need exists for a track system which is not plagued by these problems of the prior art.

DISCLOSURE OF THE INVENTION

It is thus an object of the present invention to provide a track assembly for an overhead door which has the benefits of smooth operation while at the same time being usable in areas having low headroom.

It is another object of the present invention to provide a track assembly, as above, which can easily be used with a header-mounted, pivoting motorized door operator.

It is an additional object of the present invention to provide a track assembly, as above, which is easy to assemble and install.

These and other objects of the present invention, as well as the advantages thereof over existing prior art forms, which will become apparent from the description to follow, are accomplished by the improvements hereinafter described and claimed.

In general, a track assembly adapted to be carried by the jamb of an overhead door and made in accordance with one embodiment of the present invention includes a first track segment which has a generally straight portion and a curvilinear portion having a first radius of curvature. A second track segment includes a generally straight portion and a curvilinear portion having a second radius of curvature. The second radius of curvature is different than the first radius of curvature. The curvilinear portion of one of the segments is telescopically received within the curvilinear portion of the other of the segments to provide the only connection between the segments. A first bracket is adapted to attach the first track segment to the jamb, and a second bracket is adapted to attach the second track segment to the jamb.

In accordance with another aspect of the invention, a track assembly for an overhead door includes a first track segment which is generally U-shaped in profile and which includes a generally straight portion and a curvilinear portion having only a first radius of curvature. A second track segment is generally U-shaped in profile and includes a generally straight portion and a curvilinear portion having only a second radius of curvature which is larger than the first radius of curvature. Means are provided to attach the curvilinear portion of the first track segment to the curvilinear portion of the second track segment which includes an enlarged U-shaped end profile on the end of the curvilinear portion of one of the track segments to receive the end of the curvilinear portion of the other of the track segments.

In another aspect of the invention, the track assembly includes a first track segment which is generally U-shaped in profile and which has a generally straight portion and a curvilinear portion having only a first radius of curvature. A second track segment is generally U-shaped in profile and has a generally straight portion and curvilinear portion having only a second radius of curvature. Bracket means are attachable to the first track segment and attachable to the second track segment so as to attach the first and second track segments to each other. The end of the curvilinear portion of the first track segment has an enlarged U-shaped profile to receive the end of the curvilinear portion of the second track segment.

A preferred exemplary track assembly for an overhead door made in accordance with the concepts of the present invention is shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

Figure 1:
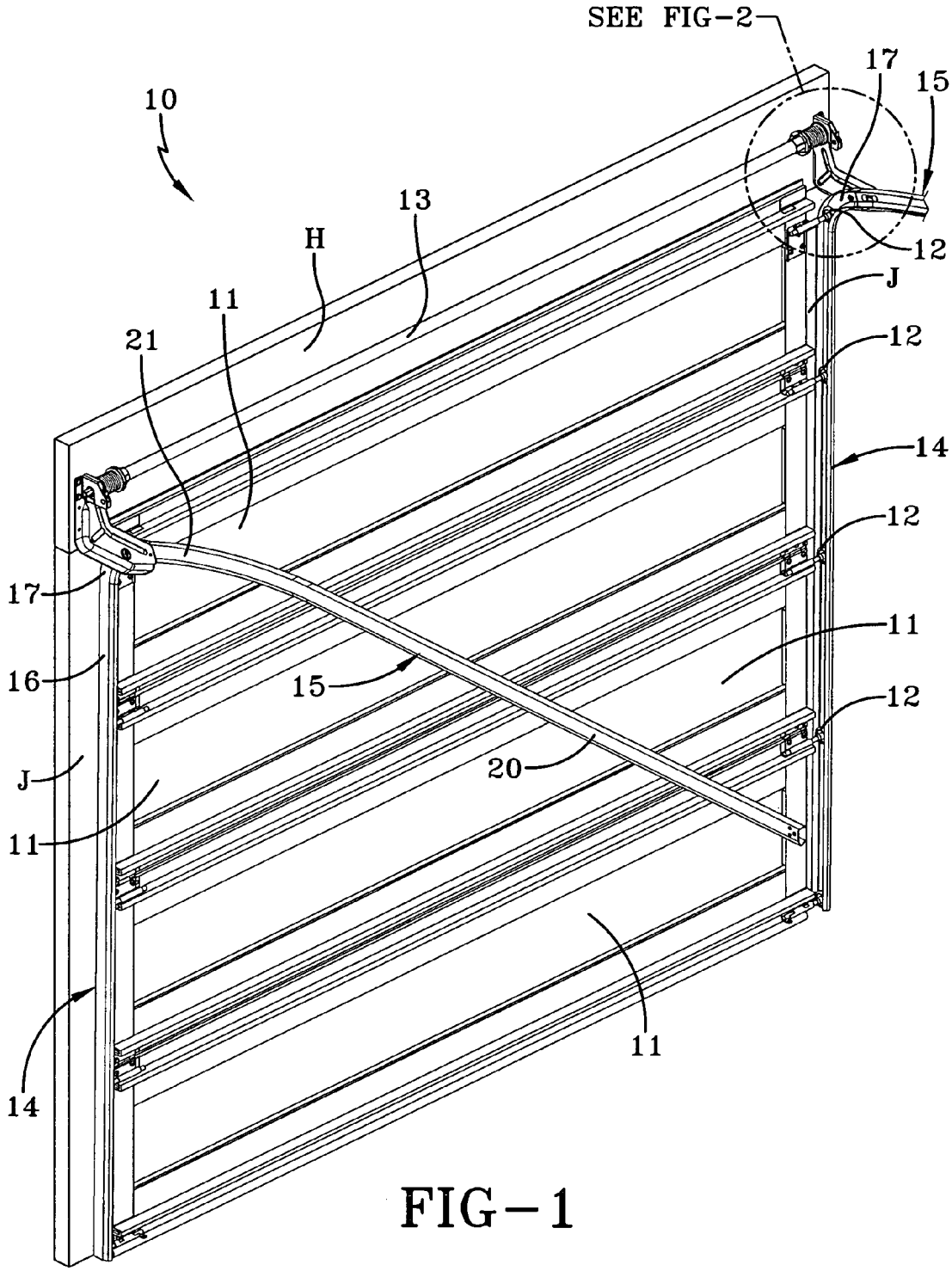
FIG. 1 is a fragmentary perspective view of a sectional overhead door having a track assembly made in accordance with the concepts of one embodiment the present invention.

An overhead-type garage door is indicated generally by the numeral 10 and includes a plurality of panels 11, each having guide rollers 12 on the lateral edges thereof. Door 10 is formed within a frame which includes vertically oriented jambs J spaced by a header H, and is suspended by a conventional counterbalance system 13 which is schematically shown in FIG. 1. Rollers 12 ride in a track assembly which includes opposed generally vertically positionable track segments, generally indicated by the numeral 14, and opposed generally horizontally positionable track segments generally indicated by the numeral 15.

Each vertically positionable track segment 14 includes a straight portion 16 which, when positioned for use with door 10, is generally vertically oriented, and includes a curvilinear portion 17 at one end thereof. Both portions 16 and 17 are generally U-shaped in end profile having opposed branches 18 interconnected by a base portion 19. As such, rollers 12 are adapted to be received between branches 18 and directed thereby as they move along track segment 14.

Similarly, each horizontally positionable track segment 15 includes a straight portion 20 which, when positioned for use with door 10, is generally horizontally oriented, and includes a curvilinear portion 21 at one end thereof. Both portions 20 and 21 are generally U-shaped in end profile having opposed branches 22 interconnected by a base portion 23. As such, rollers 12 are adapted to be received between branches 22 and directed thereby as they move along track segment 15.

It has been found that the radius of curvature of curvilinear portion 17 can be in the range of approximately four to eight inches. A radius of curvature of about four inches extending over approximately sixty-eight degrees is preferred. The radius of curvature of curvilinear portion 21 can be in the range of fifty to eighty inches depending on the height of the panels 11 which make up door 10. A radius of curvature of about seventy-one inches extending over approximately twenty-two degrees is preferred. Thus, the ratios of the radius of portion 21 to the radius of portion 17 could be in the range of approximately twenty-to-one to approximately six-to-one. The combination of these radii provide for smooth operation while at the same time rendering the door 10 useable in areas of low headroom.

Figure 2:
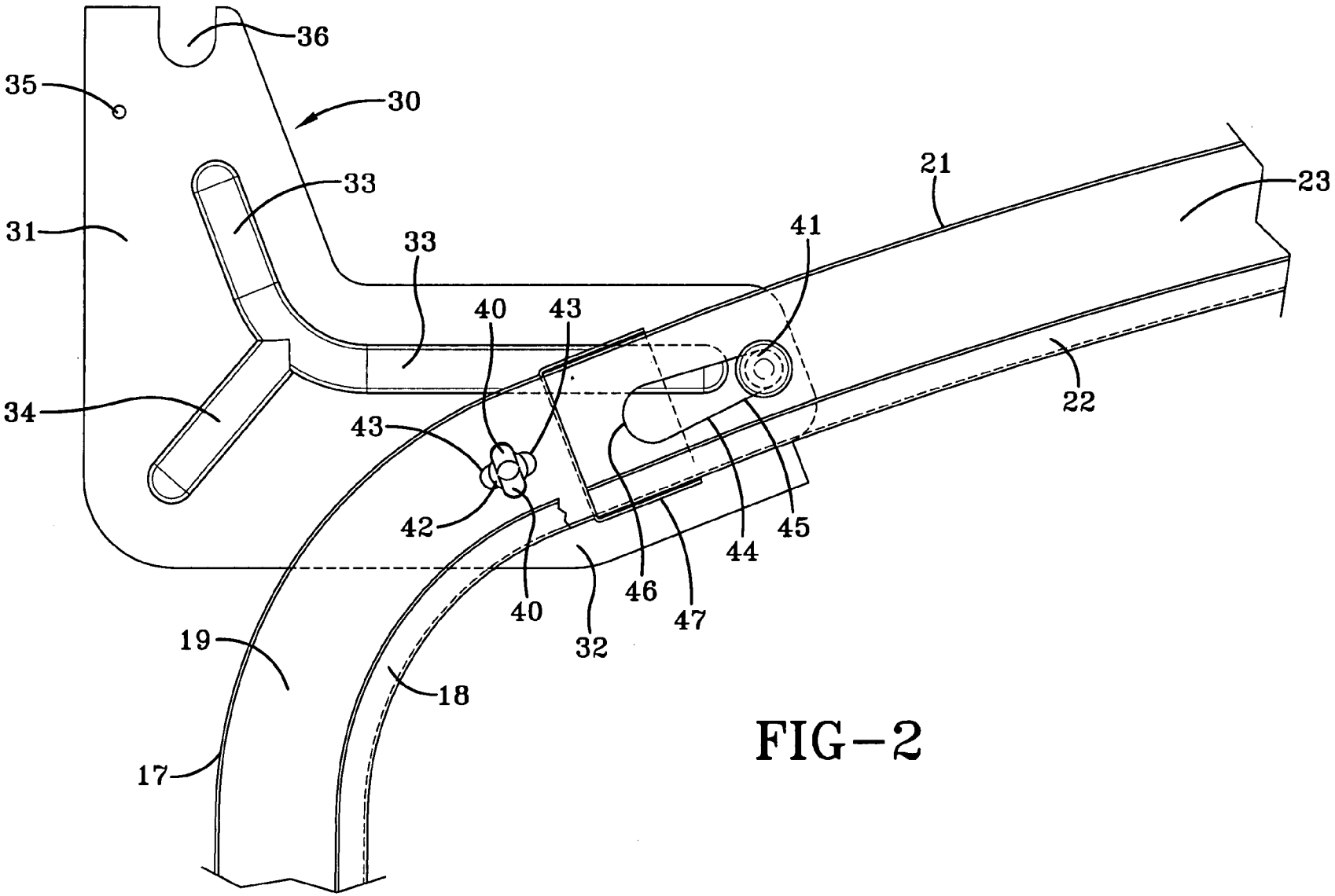
FIG. 2 is an enlarged elevational view of the portion of the track assembly encircled in FIG. 1.
Figure 3:
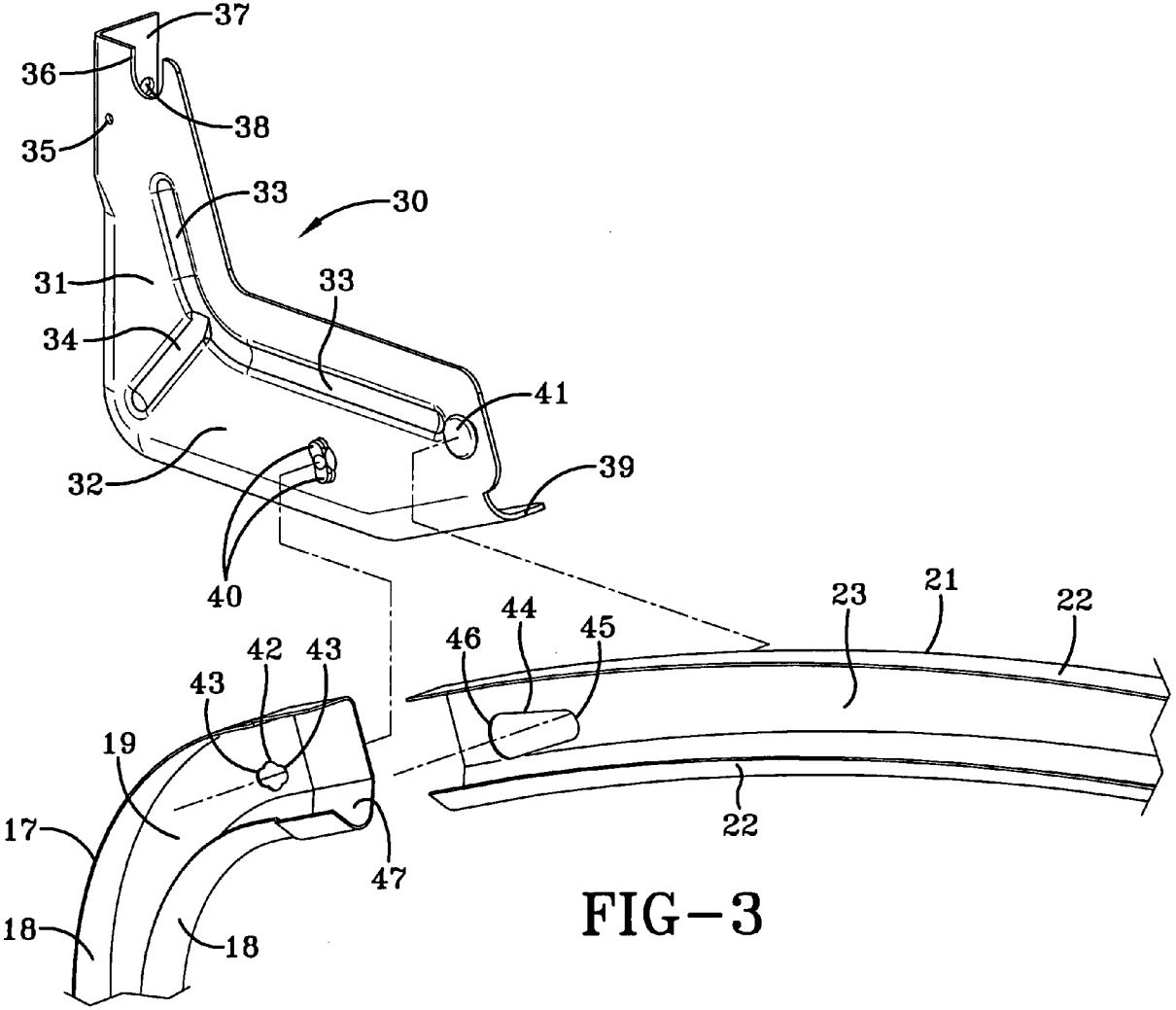
FIG. 3 is an exploded perspective view of the components of the track assembly shown in FIG. 2.

Curvilinear portion 17 is attached to curvilinear portion 21 by means of a flag angle or bracket generally indicated by the numeral 30. As shown in FIGS. 2 and 3, bracket 30 is generally L-shaped in configuration having a generally vertically oriented structural mounting face 31 and a generally horizontally oriented track engaging face 32. An offset rib 33 runs down mounting face 31 and extends into track engaging face 32, and a second offset rib 34 runs along the junction of faces 31 and 32. Together, ribs 33 and 34 add strength to bracket 30.

Mounting face 31 includes an aperture 35 to facilitate attachment to a portion of counterbalance system 13, and the top of face 31 is provided with a notch 36 to permit the passage of counterbalance system 13 therethrough. As shown in FIG. 3, face 31 is also provided with a mounting flange 37 having a plurality (one shown) of apertures 38 therein to facilitate attachment of bracket 30 to the header H or a jamb J of the frame around door 10. Flange 37 is integrally formed with a flange 39 on track engaging face 32 to further strengthen bracket 30.

Track engaging face 32 of bracket 30 is provided with a pair of tabs 40 spaced from face 32 and oriented 180° of each other. Face 32 is also provided with a lock lug 41 which is also spaced from face 32. The base portion 19 of track portion 17 is provided with a slot aperture 42 which is generally circular in shape with its circumference being interrupted by a pair of diametrically opposed semicircles 43. The base portion 23 of track portion 21 is provided with a tapered, generally tear drop-shaped, slot 44 having an end 45 with a narrow opening and an end 46 with an opening wider than the opening at end 45. The larger end 46 is positioned to be adjacent to the end of track portion 21.

In order to attach curvilinear portion 17 of track segment 14 to curvilinear portion 21 of track segment 15, and thereby install the track assembly for use with door 10, tabs 40 of bracket 30 are aligned with opposed semicircles 43 of slot aperture 42 and then pushed therethrough. Then, bracket 30 and track segment 14 can be rotated ninety degrees relative to each other so that bracket 30 is engaging track segment 14 as shown in FIG. 2. Thereafter, in order to attach curvilinear portion 21 to bracket 30 and to curvilinear portion 17 to track segment 14, the end of curvilinear portion 21 can be slid into, or otherwise telescoped into, the end of curvilinear portion 17. For this purpose, the U-shaped profile of portion 17 is enlarged near the end of portion 17, as at 47, to receive the end of portion 21. As such, there is a smooth roller transition between portions 17 and 21 so that there is no undue noise and so that there is otherwise no bumpy transition of rollers 12 as they pass between track segment 14 and track segment 15. At the same time that track portion 21 is slid into track portion 17, lug 41 of bracket 30 is received through the large end 46 of slot 44. When portion 21 is fully seated in portion 17, lug 41 will be positioned in the smaller end 45 of slot 44 such that bracket 30 is then holding track portion 21.

At this point, bracket 30 may be attached to the door frame while carrying and attaching one end of track segments 14 and 15, and the other ends of track segments 14 and 15 may be conventionally attached to the frame and surrounding structure so that track portion 21 cannot be slid out of track portion 17 and otherwise released from bracket 30.

It should be appreciated that a track assembly constructed in accordance with this embodiment and installed as described herein does not require the conventional horizontally extending support angle at the area of the transition of the track from vertical to horizontal because the long curvilinear portion 21 effectively acts to provide such support. In addition, this track assembly enables one to use a header mounted pivotal door operator without requiring additional components to account for the lack of headroom as was required in the prior art. That is, when door 10 is moving through the track assembly of the present invention, door 10 begins to move back almost immediately on track segment 15 which allows one to use a pivotal door operator which is desirable to lock the door in the down position.

Figure 4:
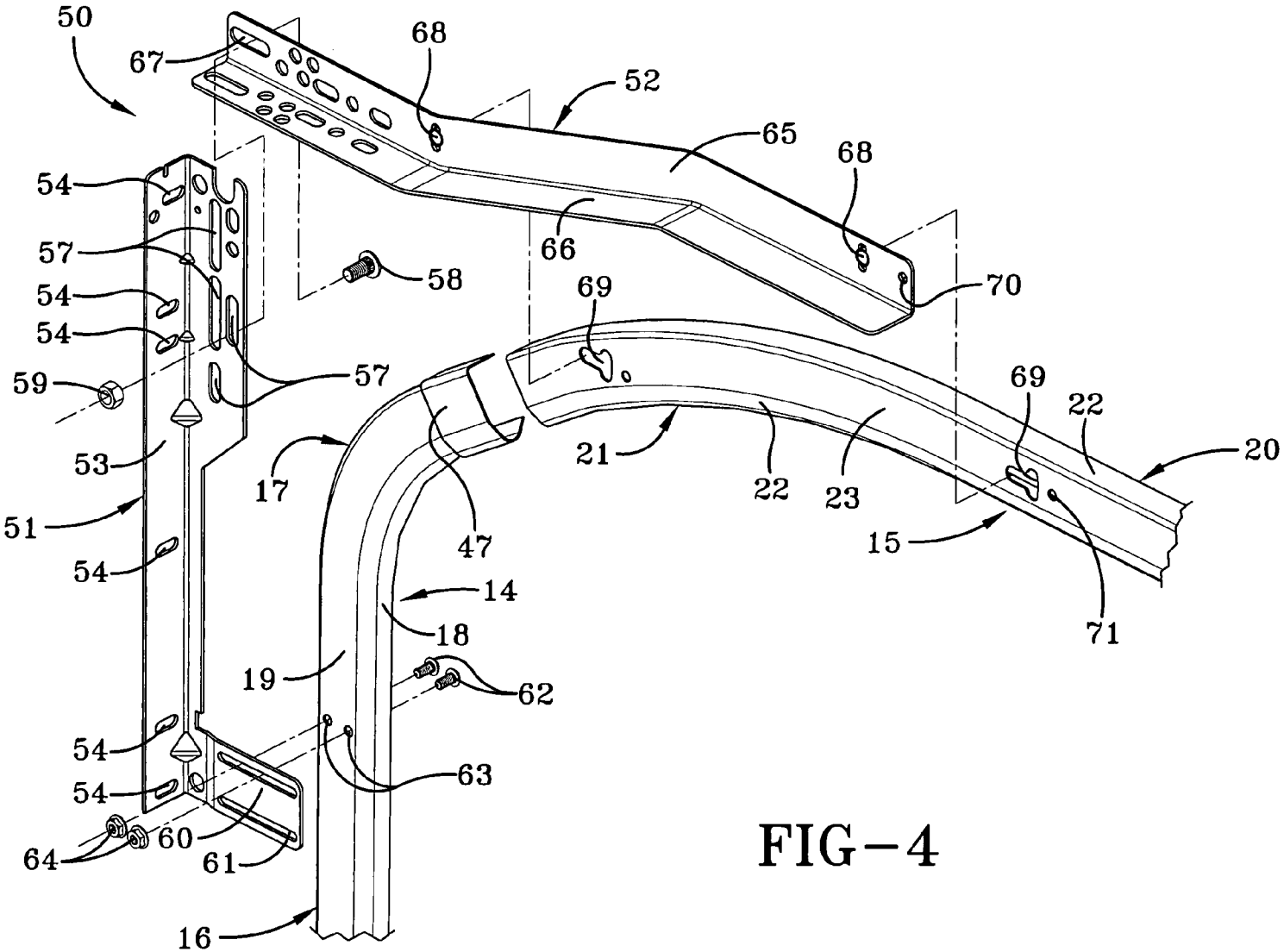
FIG. 4 is an exploded view of the components of a track assembly made in accordance with another embodiment of the present invention.
Figure 5:
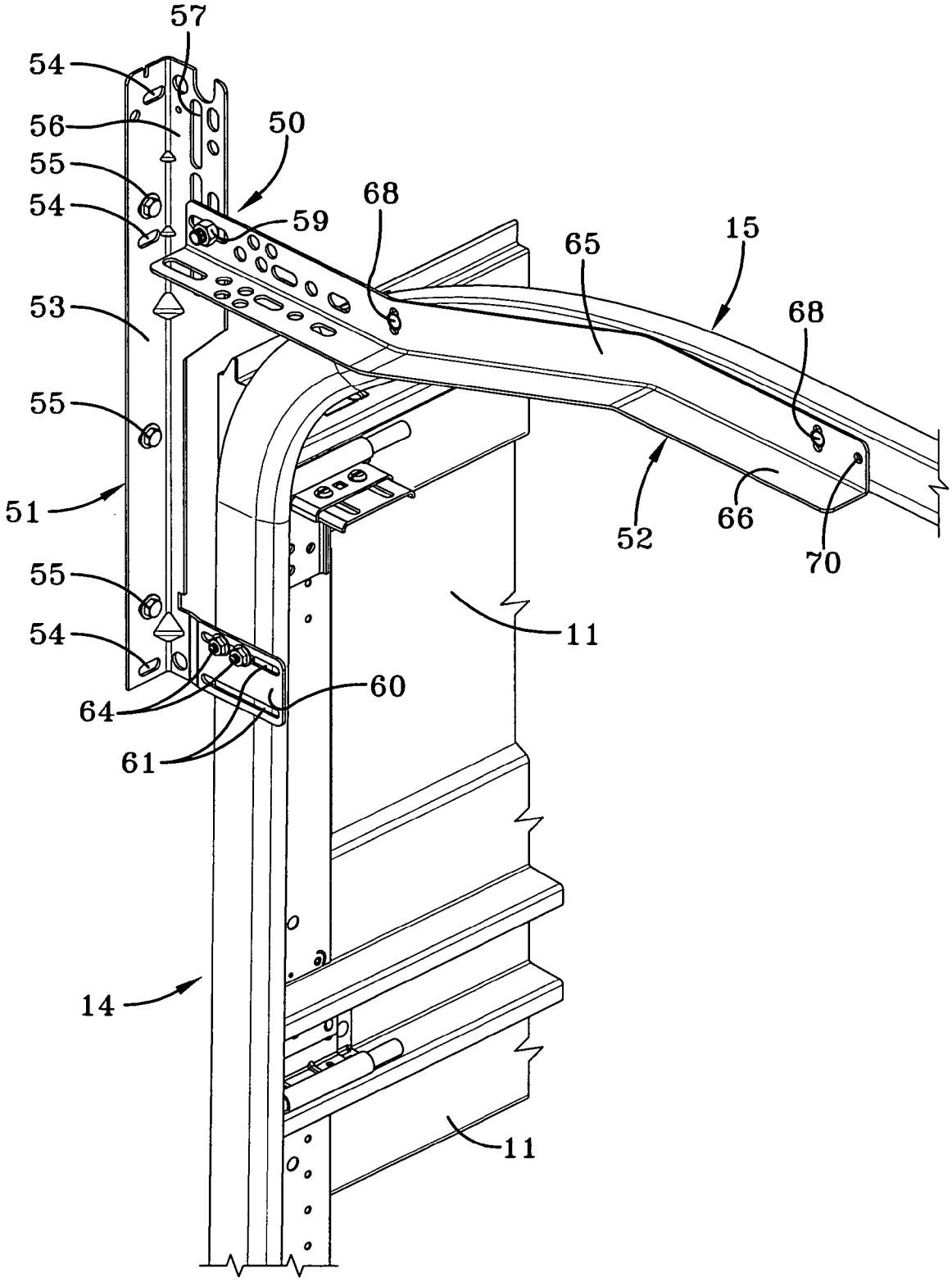
FIG. 5 is a perspective view showing the components of FIG. 4 assembled adjacent to a door.

A track assembly made in accordance with another embodiment of the invention is indicated generally by the numeral 50 and is shown in FIGS. 4 and 5. Track assembly 50 includes a vertically positionable track segment 14 and a horizontally positionable track segment 15 which, except as will hereinafter be discussed, are basically identical to that shown in FIGS. 1-3 and previously described. Thus, identical components shown in FIGS. 4 and 5 have been given the same reference numerals as that shown in FIGS. 1-3, and the description thereof will not be repeated with reference to FIGS. 4 and 5.

In addition to track segments 14 and 15, track assembly 50 includes a bracket, or what is known in the art as a flag angle, generally indicated by the numeral 51, and another angle bracket generally indicated by the numeral 52. Flag angle 51 is a conventional bracket having several features which render it usable in many types of track assemblies. When used in track assembly 50, face 53 of bracket 51 is provided with a plurality of apertures 54, selected of which receive fasteners 55 (FIG. 5) to attach bracket 51 to jamb J. A second face 56 of bracket 51 is provided with a plurality of vertical slot apertures 57 to receive one or more fasteners 58 with a nut 59 to attach bracket 52 to bracket 51 in a manner to be hereinafter described. Bracket 51 is also provided with a flag or tab 60 having slot apertures 61 formed therein. Tab 60 is attached to track segment 15 by fasteners 62 which pass through holes 63 in track segment 15, and through slot apertures 61 to be held by nuts 64.

Angle bracket 52 includes angled faces 65 and 66 and is also a conventional item having several features which render it usable in many types of track assemblies. When used in track assembly 50, a slot aperture 67 in face 65 is used to receive bolt 58 as previously described to attach bracket 52 to bracket 51 and thereby to jamb J as well. Face 65 also includes longitudinally spaced apertures 68 which are adapted to receive fasteners (not shown) to attach bracket 52 to track segment 15. To that end, track segment 15 is provided with spaced key-hole slots 69 which are alignable with apertures 68 to receive the fasteners. If necessary, bracket 52 may also be provided with an aperture 70 adjacent to at least one of the apertures 68 which may be aligned with an aperture 71 in track segment 15 and receive a fastener (not shown) to maintain the other fasteners in slots 69.

Thus, flag angle bracket 51, which is attached to jamb J, carries the vertical track segment 14 and the angle bracket 52 which, in turn, carries the horizontal track segment 15. The curvilinear portion 21 of track segment 15 telescopes within enlarged end 47 of curvilinear portion 17 of track segment 14, which is advantageously the only connection between track segments 14 and 15.

To assemble track assembly 50, flag angle bracket 51 is preferably first attached to jamb J and to track segment 14, and angle bracket 52 is attached to track segment 15 as previously described. The end of track segment 15 can then be telescoped into the end of track segment 14, and angle bracket 52 may then be attached to flag angle bracket 51 as previously described.

As such, the track assemblies described herein substantially improve the art and otherwise accomplish the objects of the present invention.

What is claimed is:

1. An overhead door track assembly adapted to be carried by a jamb of an overhead door comprising a one-piece first track segment having a length including a substantially straight portion and a curvilinear portion having a first radius of curvature, a one-piece second track segment separate from said first track segment and having a length including a substantially straight portion and a curvilinear portion having a second radius of curvature different than the first radius of curvature, a cross-section of said first and second track segments defining a generally U-shaped profile, the curvilinear portion of one of said segments being telescopically received within the curvilinear portion of the other of said segments to provide the only connection between said segments, a first bracket adapted to attach only said first track segment to the jamb, and a second bracket adapted to attach only said second track segment to the jamb.

2. The overhead door track assembly of claim 1 wherein said second bracket is attached to said first bracket.

3. The overhead door track assembly of claim 1 wherein said second bracket is attached to said second track segment at at least two spaced locations.

4. The overhead door track assembly of claim 1 wherein said first radius of curvature is smaller than said second radius of curvature.

5. The overhead door track assembly of claim 1 wherein said first track segment has no radius of curvature other than said first radius of curvature.

6. The overhead door track assembly of claim 5 wherein said second track segment has no radius of curvature other than said second radius of curvature.

7. The overhead door track assembly of claim 1, the end of the curvilinear portion of one of said segments having an enlarged U-shaped profile that receives the end of the curvilinear portion of the other of said segments.

8. An overhead door track assembly for an overhead door comprising a one-piece first track segment having a length including a substantially straight portion and a curvilinear portion having a first radius of curvature, and a one-piece second track segment separate from said first track segment and having a length including a substantially straight portion and a curvilinear portion having a second radius of curvature different from the first radius of curvature, a cross-section of said first and second track segments defining a generally U-shaped profile, said curvilinear portion of said first track segment being attached to said curvilinear portion of said second track segment.

9. An overhead door track assembly to receive rollers of an overhead door comprising a one-piece first track segment having a generally straight portion and a curvilinear portion having a first radius of curvature, the rollers being adapted to move along said substantially straight portion and said curvilinear portion of said first track segment, and a one-piece second track segment separate from said first track segment and having a substantially straight portion and a curvilinear portion having a second radius of curvature, the rollers being adapted to move along said substantially straight portion and said curvilinear portion of said second track segment, said second radius of curvature being different from said first radius of curvature, a cross-section of said first and second track segments defining a generally U-shaped profile, said curvilinear portion of said track segments being attached to each other so that as the rollers move along said curvilinear portion of said first track segment they are received by said curvilinear portion of said second track segment.

* * * * *